US010323391B2

(12) United States Patent
Balan et al.

(10) Patent No.: US 10,323,391 B2
(45) Date of Patent: Jun. 18, 2019

(54) HEAVY DUTY SHROUD

(71) Applicant: Caterpillar Inc., Peoria, IL (US)

(72) Inventors: Mihai Mircea Balan, Dunlap, IL (US); Douglas C. Serrurier, Morton, IL (US)

(73) Assignee: Caterpillar Inc., Deerfield, IL (US)

( * ) Notice: Subject to any disclaimer, the term of this patent is extended or adjusted under 35 U.S.C. 154(b) by 0 days.

(21) Appl. No.: 15/690,994

(22) Filed: Aug. 30, 2017

(65) Prior Publication Data

US 2019/0063045 A1 Feb. 28, 2019

(51) Int. Cl.

*E02F 9/28* (2006.01)
*E02F 3/34* (2006.01)
*E02F 3/40* (2006.01)

(52) U.S. Cl.

CPC ..... *E02F 9/2883* (2013.01); *E02F 3/34* (2013.01); *E02F 3/40* (2013.01); *E02F 9/2825* (2013.01); *E02F 9/2858* (2013.01)

(58) Field of Classification Search

CPC ..... E02F 9/2883; E02F 9/2825; E02F 9/2858; E02F 9/2808; E02F 9/2816; E02F 9/2875; E02F 3/34; E02F 3/40

See application file for complete search history.

(56) References Cited

U.S. PATENT DOCUMENTS 5,709,043 A * 1/1998 Jones ..... E02F 9/2825 37/458
8,959,807 B2 * 2/2015 LaHood ..... E02F 3/8152 37/455
9,057,177 B2 * 6/2015 Renski ..... E02F 9/2808
9,447,564 B2 9/2016 Kunz
9,677,252 B2 * 6/2017 Simpson ..... E02F 9/2825
2011/0099862 A1 * 5/2011 Snyder ..... E02F 9/2825 37/455
2012/0131821 A1 * 5/2012 Brufau Guinovart . B22D 19/06 37/452
2013/0086825 A1 * 4/2013 Renski ..... E02F 9/2808 37/452
2013/0086827 A1 * 4/2013 Renski ..... E02F 9/2825 37/452
2014/0223786 A1 * 8/2014 Rol Corredor ..... E02F 9/2841 37/459
2015/0096207 A1 4/2015 Tasovski
2017/0145664 A1 * 5/2017 Campomanes ..... E02F 9/2833
2017/0145665 A1 * 5/2017 Jeske ..... E02F 9/2825

FOREIGN PATENT DOCUMENTS

EP 0752031 1/1997

* cited by examiner

*Primary Examiner* — Jamie L McGowan
(74) *Attorney, Agent, or Firm* — Law Office of Kurt J. Fugman LLC

(57) ABSTRACT

A shroud configured to be attached to a work implement comprises a ground engaging surface with a convex arcuate portion, a first concave arcuate portion on one side of the convex arcuate portion, and a second concave arcuate portion on the other side of the convex arcuate portion, or an upper outside loading surface extending from the ground engaging surface including a first concave arcuate loading portion, a first convex arcuate loading portion, and a second convex arcuate loading portion, or a slot the defines a front clearance face with a first rearward facing pad therefrom.

14 Claims, 12 Drawing Sheets

HEAVY DUTY SHROUD

TECHNICAL FIELD

The present disclosure relates to the field of machines that perform work on a material using work implements such as mining, construction and earth moving machines and the like. Specifically, the present disclosure relates to ground engaging tools including adapters, tips and shrouds used on buckets and the like that are durable and capable of enduring high loads.

BACKGROUND

During normal use on machines such as mining, construction, and earthmoving machines and the like, ground engaging tools such as adapters, tips and shrouds attached to the lips of buckets and the like may experience stresses in various portions of the adapter, tip or tool and shrouds. It is not uncommon for these components to see extremely high loads due to severe operating or material conditions. Consequently, these ground engaging tools may have portions that may be weakened over time, requiring that the adapter, tip and shrouds be repaired or replaced. This can lead to undesirable maintenance and downtime for the machine and the economic endeavor that employs the machine using the bucket and ground engaging tools.

Specifically, wheel loaders, such as large wheel loaders, are used in extremely demanding environments such as quarries or mines and the like. These wheel loaders employ buckets that have ground engaging tools such as adapters, tips and shrouds that are subjected to high loads in use. For example, these work implements are often used to break up, lift, and carry rock from one location at a work sight to another. The payload demands for these machines are increasing, requiring that the ground engaging tools be more durable than ever before.

Accordingly, it is desirable to develop a heavy duty adapter, tip or tool, and shroud that may satisfy these demanding needs.

SUMMARY OF THE DISCLOSURE

A shroud configured to be attached to a work implement according to an embodiment of the present disclosure comprises a body defining a closed end and an open end, a first side surface and a second side surface, a working portion disposed proximate the closed end, a first leg extending rearward from the working portion to the open end, a second leg extending rearward from the working portion to the open end, and a throat portion that connects the legs and working portion together. The first and second legs define a slot, the slot defining a direction of assembly onto a work implement and the body defines a Cartesian coordinate system having a X-axis, a Y-axis and a Z-axis and defining a X-Y plane, a X-Z plane, and a Y-Z plane, wherein the X-axis is parallel with the direction of assembly. The working portion defines a ground engaging surface at the closed end comprising a convex arcuate portion intersecting with the X-axis, a first concave arcuate portion extending from the convex arcuate portion toward the first side surface, and a second concave arcuate portion extending from the convex arcuate portion toward the second side surface when the ground engaging surface is projected onto a X-Y plane along the Z-axis.

A shroud configured to be attached to a work implement according to an embodiment of the present disclosure comprises a body defining a closed end and an open end, a first side surface and a second side surface, a working portion disposed proximate the closed end, a first leg extending rearward from the working portion to the open end, a second leg extending rearward from the working portion to the open end, and a throat portion that connects the legs and working portion together. The first and second legs define a slot, the slot defining a direction of assembly onto a work implement and the body defines a Cartesian coordinate system having a X-axis, a Y-axis and a Z-axis and defining a X-Y plane, a X-Z plane, and a Y-Z plane, wherein the X-axis is parallel with the direction of assembly. The working portion defines a ground engaging surface at the closed end and an upper outside loading surface extending from the ground engaging surface toward the open end and the first leg, the upper outside loading surface comprising a first concave arcuate loading portion extending from the ground engaging surface toward the first leg, a first convex arcuate loading portion extending from the first concave arcuate loading portion toward the first leg, and a second convex arcuate loading portion extending from the first convex arcuate loading portion toward the first leg.

A shroud configured to be attached to a work implement according to an embodiment of the present disclosure comprises a body defining a closed end and an open end, a first side surface and a second side surface, a working portion disposed proximate the closed end, a first leg extending rearward from the working portion to the open end, a second leg extending rearward from the working portion to the open end, and a throat portion that connects the legs and working portion together. The first and second legs define a slot, the slot defining a direction of assembly onto a work implement and the body defines a Cartesian coordinate system having a X-axis, a Y-axis and a Z-axis and defining a X-Y plane, a X-Z plane, and a Y-Z plane, wherein the X-axis is parallel with the direction of assembly. The slot defines a front clearance face and the body further includes a first rearward facing pad extending from the front clearance face along the X-axis adjacent the first side surface and a second rearward facing pad extending from the front clearance face along the X-axis adjacent the second side surface.

BRIEF DESCRIPTION OF THE DRAWINGS

The accompanying drawings, which are incorporated in and constitute a part of this specification, illustrate several embodiments of the disclosure and together with the description, serve to explain the principles of the disclosure. In the drawings.

DETAILED DESCRIPTION

Figure 1:
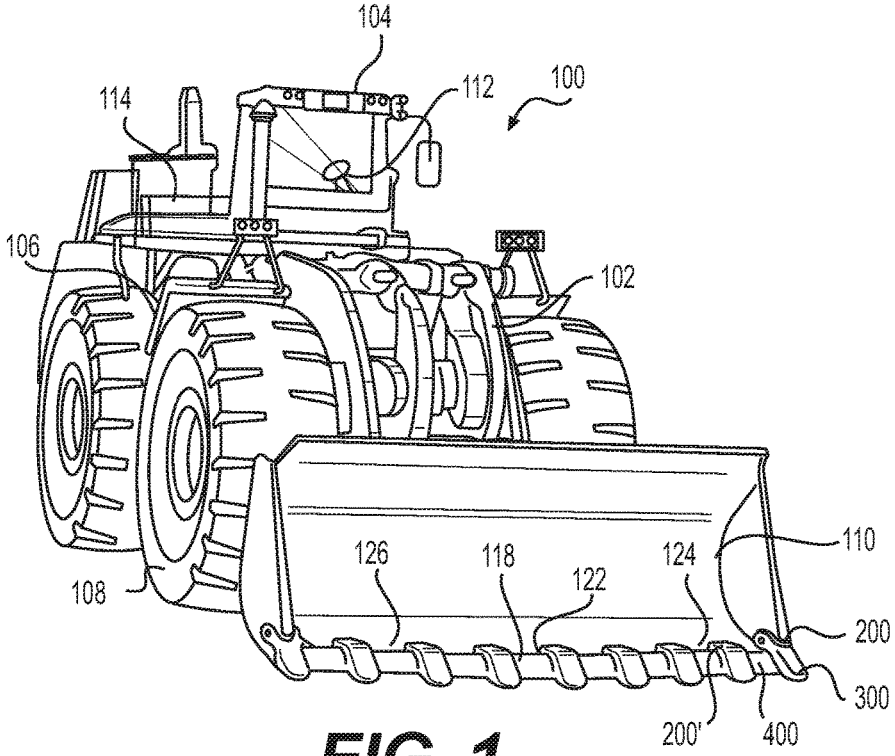
FIG. 1 is a perspective view of a machine in the form of a wheel loader using a work implement in the form of a bucket that has a front lip with heavy duty shroud or lip protectors, heavy duty adapters and heavy duty tips attached to the bucket according to one embodiment of the present disclosure.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100a, 100b or a prime indicator such as 100', 100" etc. It is to be understood that the use of letters or primes immediately after a reference number indicates that these features are similarly shaped and have similar function as is often the case when geometry is mirrored about a plane of symmetry. For ease of explanation in this specification, letters or primes will often not be included herein but may be shown in the drawings to indicate duplications of features discussed within this written specification.

Various embodiments of an adapter, tip configured to be attached to the adapter, and a shroud configured to be attached to a working edge such as a lip of a work implement such as a bucket will be described.

Figure 2:
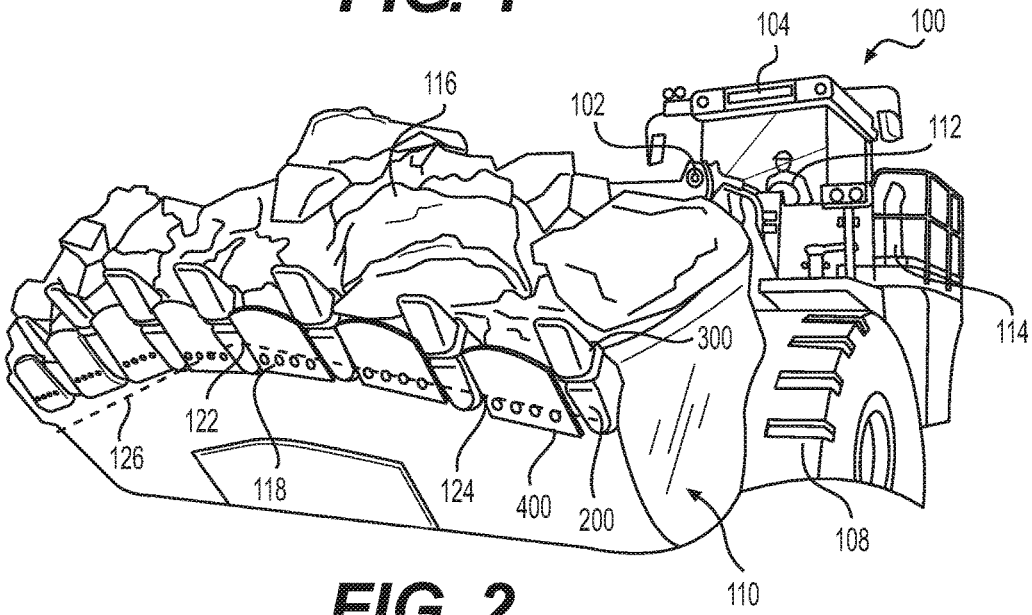
FIG. 2 is an alternate perspective view of a machine and bucket with heavy duty shrouds, heavy duty adapters and heavy duty tips, similar to that shown in FIG. 1, according to an embodiment of the present disclosure, showing the bucket elevated and tilted upwardly, moving a payload of rocks.

In the example shown in FIGS. 1 and 2, the machine 100 is a large wheel loader and includes a linkage system for attaching a work implement, an operator cab 104, a chassis 106, tires 108, and a hood covering a power source 114, such as an internal combustion engine. The linkage system 102 has an attachment coupler (not shown) at its free end configured to hold work implement such as a bucket 110. The operator cab 104 includes, among other components, a steering system 112 to guide the machine 100 in various spatial directions. The operator cab 104 may be suitably sized to accommodate a human operator. Alternatively, the machine 100 may be controlled remotely from a base station, in which case, the operator cab 104 may be smaller or eliminated. The steering system 112 may be a steering wheel or a joystick, or other control mechanism to guide a motion of the machine 100, or parts thereof. Further, the operator cab 104 may include levers, knobs, dials, displays, alarms, etc. to facilitate operation of the machine 100.

The work implement or tool is a bucket 110 as shown in FIGS. 1 and 2 but various embodiments of an adapter 200, tip 300 and/or shroud 400 may be used with other work implements such as a rake, etc. The linkage system 102 is moved by the power source 114 of the machine 100 so that the bucket 110 can dig into earth, dirt, rock, soil, etc. Then, the bucket 110 may be lifted and tilted up and suspended, holding its payload 116 (e.g. rocks) while the machine 100 moves to a dump site (see FIG. 2). As can be imagined, the digging process may exert loads onto the adapter 200, tip 300 and shroud 400 that could weaken these components over time. Therefore, these components are designed to be replaceable. Though not clearly discernable in FIGS. 1 thru 4, the adapter 200, tip 300 and shroud 400 have certain features according to various embodiments of the present disclosure, which will be discussed in further detail later herein.

Figure 3:
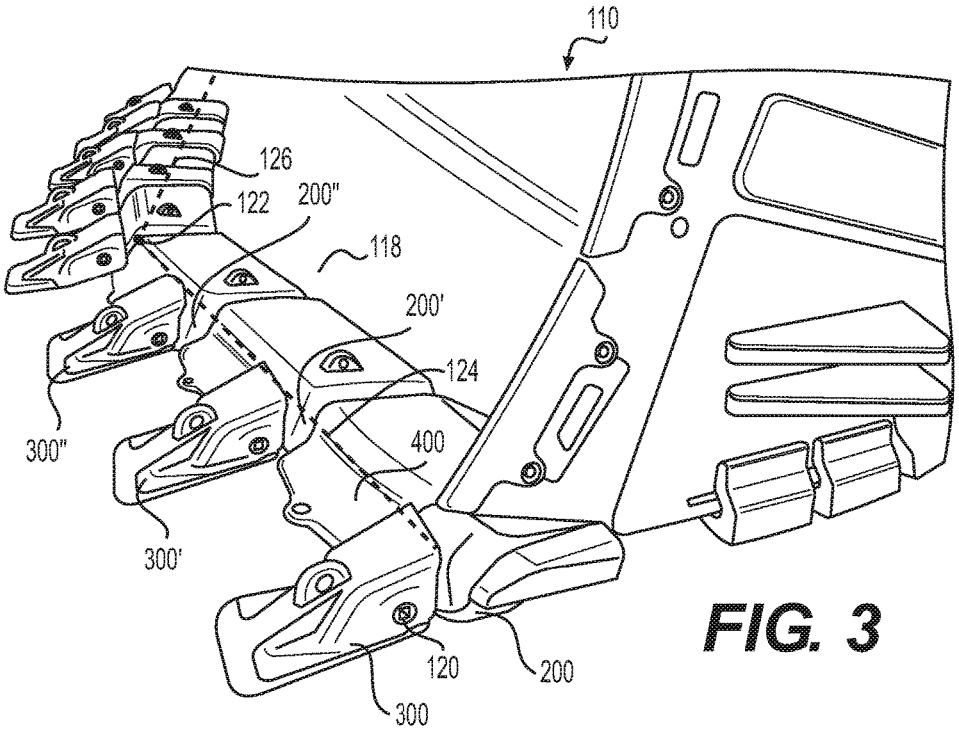
FIG. 3 is a side perspective view of a bucket with heavy duty shrouds, heavy duty adapters and heavy duty tips, similar to that shown in FIGS. 1 and 2, according to an embodiment of the present disclosure.
Figure 4:
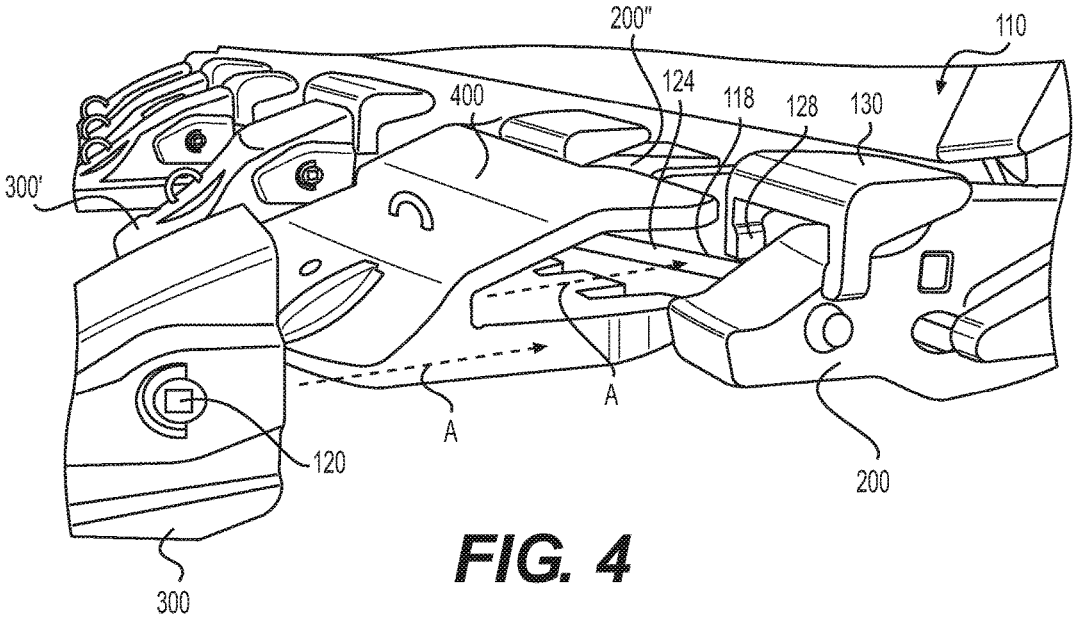
FIG. 4 is a partially exploded assembly view, illustrating the attachment of a heavy duty shroud onto a lip of a bucket and a heavy duty tip onto a heavy duty adapter according to an embodiment of the present disclosure.

Turning now to FIGS. 3 and 4, the shroud 400 and adapter 200 may be attached to the front lip 118 of a bucket 110 or other working edge of another work implement. The shroud 400 and adapter 200 in FIGS. 3 and 4 may be attached to the front lip by welding or by an attachment mechanism. More particularly, for the embodiments shown in FIGS. 3 and 4, the adapter 200 may be welded to the front lip 118 of the bucket 110 while the shroud 400 may be attached to the front lip 118 using an attachment mechanism 120 sold by the assignee of the present application under the TRADENAME of CAPSURE. Other attachment mechanisms are possible. The tip 300 is also attached to the adapter 200 using the CAPSURE attachment mechanism 120.

For the bucket 110 shown in FIGS. 1 thru 4, the front lip 118 of the bucket 110 has a V-shaped configuration, with the vertex 122 disposed at the centerline or midplane of the bucket 110. Consequently, the shroud 400, adapter 200, or tip 300 may have different configurations depending on where along the front lip 118 the component is placed. For example, the adapters 200 may have a straight configuration, left corner configuration, or a right corner configuration, etc.

For the embodiments shown in FIGS. 1 thru 4, the adapters 200 all have a straight configuration but this might not the case in other embodiments. The shrouds 400 in FIG. 2 include a center shroud 400*a*, disposed at the vertex 122 of the front lip 118, left handed shrouds 400*c* configured to mate with the left angled portion 124 of the front lip of the bucket (when viewed from behind the bucket), and right handed shrouds 400*b* configured to mate with the right angled portion 126 of the front lip 118 of the bucket 110 (when viewed from behind the bucket). The tips 300 in FIGS. 1 thru 4 are all similarly configured but it is contemplated that their configuration could vary in other embodiments.

It is further contemplated that the working edge of the work implement may be straight, allowing the shrouds, tips and adapters to have a consistent configuration. In many embodiments, an alternating pattern of tips and adapters and shrouds along the working edge is provided as shown in FIGS. 1 thru 4.

Focusing on FIG. 4, it can be seen that the direction of assembly A for all the components, regardless if they are shrouds, adapters or tips is in a straight rearward direction regardless of their position relative to the angled portions 124, 126 or vertex 122 of the front lip 118 of the bucket 110.

Figure 5:
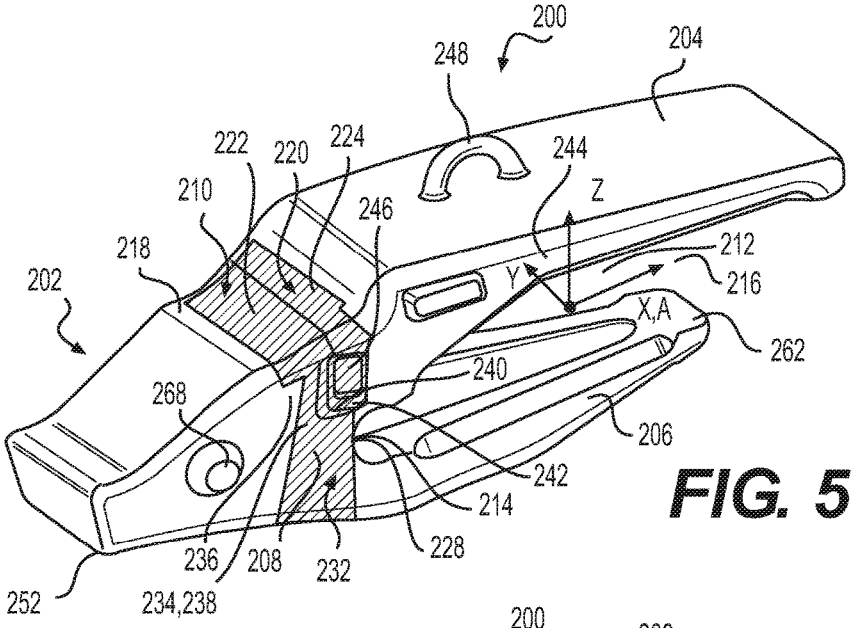
FIG. 5 is a top oriented perspective view of a heavy duty adapter according to an embodiment of the present disclosure, showing reinforced portions highlighted.
Figure 6:
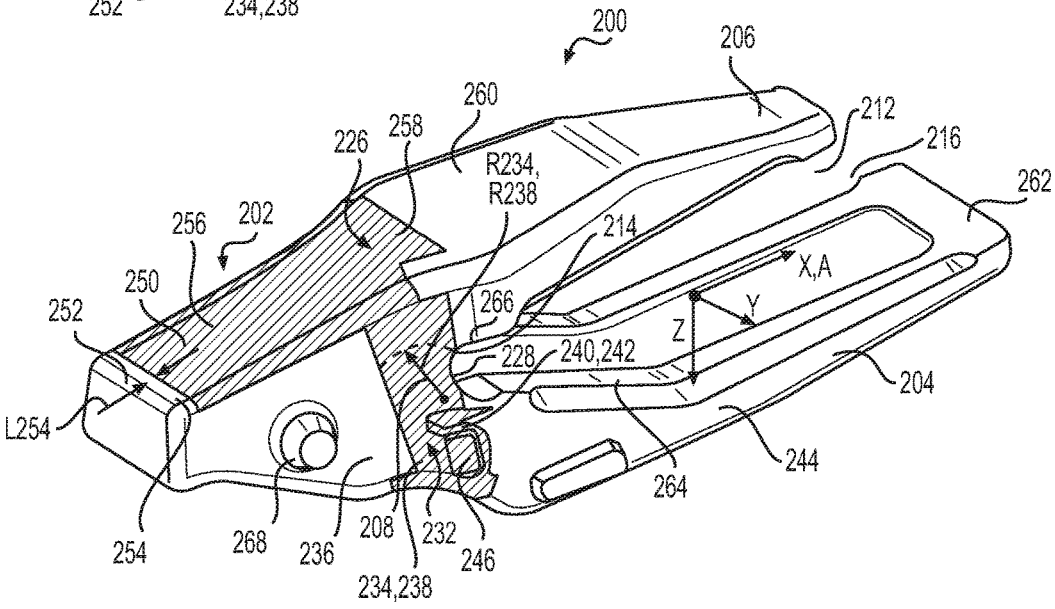
FIG. 6 is a bottom oriented perspective view of the heavy duty adapter of FIG. 5.

FIGS. 5 thru 10 illustrate an adapter 200 according to an embodiment of the present disclosure. As best seen in FIGS. 5 and 6, the adapter 200 includes reinforced portions indicated by the cross-hatching, helping the adapter withstand heavy loads in use. As used herein, the term "tip adapter" means that the adapter is configured to allow a tip, tool or tool bit, etc. to be attached to the adapter with the adapter acting as connecting point to the work implement. It is contemplated that the tip adapter may be integral or unitary with the work implement in some embodiment, readily attachable to or detachable from the work implement in other embodiment, etc. The term "arcuate" includes any bowed shape including polynomial, sinusoidal, spline, radial, elliptical, etc. Similarly, any blend or transitional surface may include any of these arcuate shapes or may be flat, etc.

Furthermore, as used herein, the terms "upper", "lower", "top", "bottom", "rear", "rearward", "forward", "forwardly", etc. are to be interpreted relative to the direction of assembly of the component onto a front lip of a bucket or the like but also includes functional equivalents when the components are used in other scenarios. In such cases, these terms including "upper" may be interpreted as "first" and "lower" as "second", etc. Reference to a Cartesian coordinate system will also be made. Such coordinate systems inherently define a X-axis, Y-axis, and Z-axis as well as corresponding X-Y, X-Z, and Y-Z planes.

Looking at FIGS. 5 thru 10, a tip adapter 200 may be provided for attaching a tip 300 to a work implement such as a bucket. The tip adapter 200 may comprise a nose portion 202 that is configured to facilitate the attachment of a tip, a first leg 204 extending rearward, a second leg 206 extending rearward, and a throat portion 208 that connects the legs 204, 206 and nose portion 202 together and that includes a top throat surface 210 that spans from the nose portion 202 to the first leg 204. The first and second legs 204, 206 are space away from each other and define a slot 212 that includes a closed end 214 and an open end 216. Hence, the slot 212 defines a direction of assembly A onto a work implement. Similarly, the tip adapter 200 defines a Cartesian coordinate system (X-axis, Y-axis, and Z-axis are orthogonal to each other) wherein the X-axis is parallel with the direction of assembly A. In the FIGS. 5 thru 10, the X-axis is also to be understood to pass through the center of mass of the tip adapter.

Figure 8:
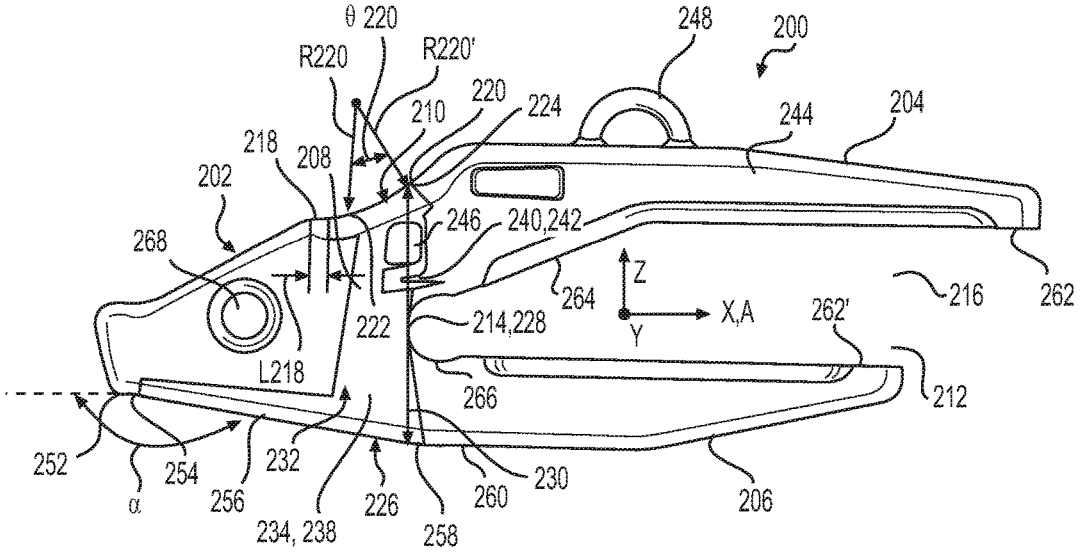
FIG. 8 is a side view of the heavy duty adapter of FIG. 5.
Figure 9:
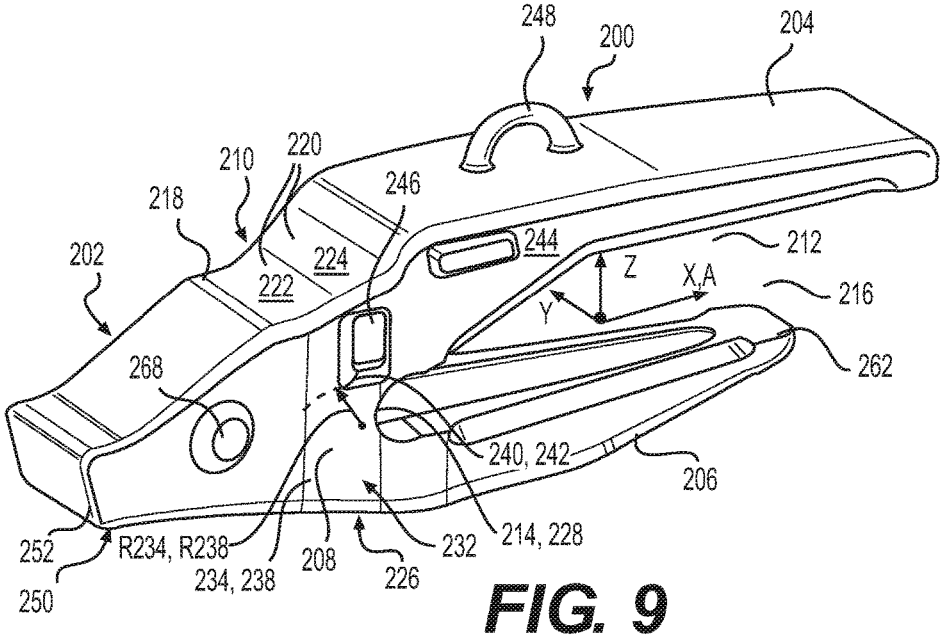
FIG. 9 depicts the heavy duty adapter of FIG. 5 without highlighting the reinforced portions.

As best seen in FIGS. 5, 8 and 9, the top throat surface 210 includes a top flat portion 218 that is parallel to the direction of assembly A and a top radial portion 220 that extends rearward from the top flat portion 218. The top arcuate portion 220 defines a radius of curvature R220 projected onto a X-Z plane along the Y-axis ranging from 100 mm to 300 mm in some embodiments. The top arcuate portion 220 may be divided into a first part 222 and a second part 224, each having different radii of curvatures as shown. In some embodiments, the first part 222 and second part 224 may mimic or be an exact radius. The top flat portion 218 may define a top flat portion length L218 measured along the X-axis ranging from 5 mm to 20 mm in some embodiments. The top arcuate portion 220 may define an angle of extension e220 projected onto the X-Z plane along the Y axis ranging from 0 degrees to 90 degrees and may be approximately 60 degrees in some embodiments.

It may be useful to design the top flat portion length L218 and the radius of curvature R220 of the top arcuate portion 220 so that enough bearing surface area is provided by the top flat portion 218 and the radius of curvature R220 is generous enough so that stress concentrations are kept to minimum. The tradeoff between these desired properties may be expressed as a ratio. That is to say, the tip adapter 200 may defines a ratio of the radius of curvature R220 of the top arcuate portion 220 to the top flat portion length L218 ranging from 15:1 to 20:1 in some embodiments.

Figure 24:
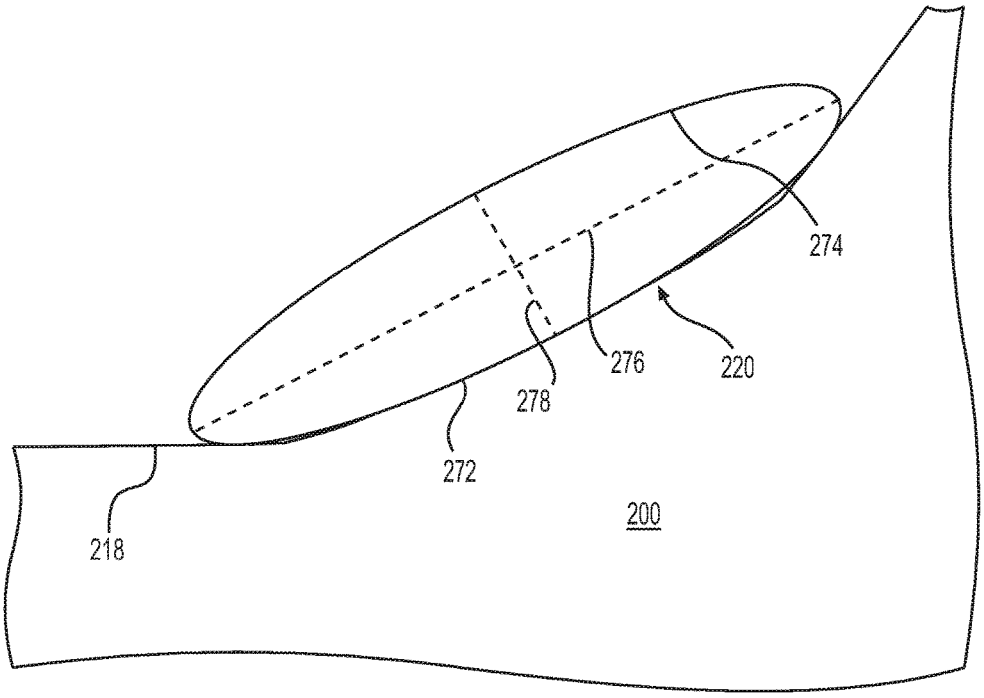
FIG. 24 is an enlarged side view of the tool adapter of FIG. 8, showing that the top arcuate blend may take the form of an ellipse.

Turning now to FIG. 24, it can be seen that the top arcuate portion 220 may comprise an elliptical surface 272. This elliptical surface may be defined by an ellipse 274 projected onto the X-Z plane along the Y direction. The ellipse 274 defines a major axis 276 running substantially along the X direction and a minor axis 278 perpendicular to the major axis 276. The ratio of the minor axis 278 to the major axis 276, sometimes referred to as the conical parameter, may range from 0.2 to 0.4 in some embodiments, and may be approximately 0.23 to 0.3 in certain embodiments. These dimensions may be varied as needed or desired. This elliptical surface 272 may have radius of curvature that ranges as previously described relative to the top arcuate portion 220.

Figure 10:
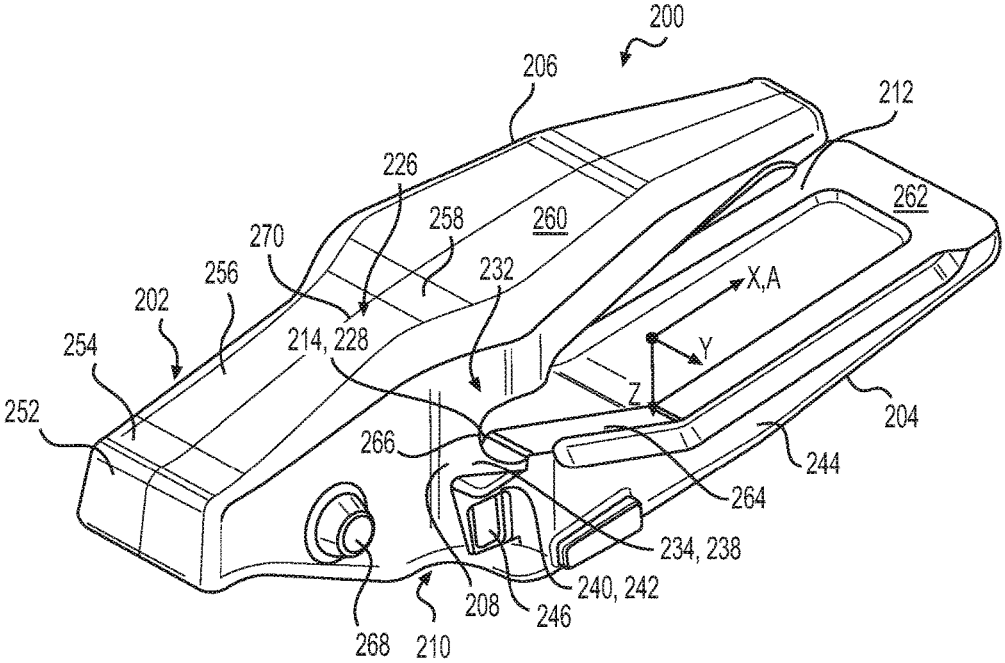
FIG. 10 depicts the heavy duty adapter of FIG. 6 without highlighting the reinforced portions and adding more contour lines.

As best seen in FIGS. 6, 8 and 10, the throat portion 208 further includes a bottom throat surface 226, and the slot 212 defines a forward extremity 228 at the closed end 214. The tip adapter 200 further defines a distance 230 from the top throat surface 210 to the bottom throat surface 226 measured along the Z-axis at the forward extremity 228 of the slot 212 ranging from 220 mm to 250 mm in some embodiments. This distance allows the tip adapter to have suitable strength in certain embodiments.

Looking at FIGS. 5 thru 10, the throat portion 208 defines a side throat surface 232 extending substantially (i.e. at least the majority of the distance) from the top throat surface 210 to the bottom throat surface 226. The side throat surface 232 may define a conical blend portion 234 defining a radius of curvature R234 increasing from proximate the top throat surface 210 toward the bottom throat surface 226. The radius of curvature R234 of the conical blend portion 234 may range from 50 mm to 250 mm in some embodiments. The side throat surface 232 may be further characterized as spanning from the nose portion 202 to the first leg 204 and to the second leg 206 in a rearward manner (along the X direction or along the X-axis). The side throat surface 232 includes a side flat portion 236 that extends rearward and a variable blend portion 238 connected to the side flat portion 236 and that extends substantially along the Z-axis. As alluded to earlier, the variable blend portion 238 defines a radius of curvature R238 projected onto a X-Y plane substantially along the Z-axis ranging from 200 mm to 270 mm. In some embodiments, the variable blend portion is a conical blend portion, but other variable blends could be used or a consistent blend could be used, etc.

Figure 7:
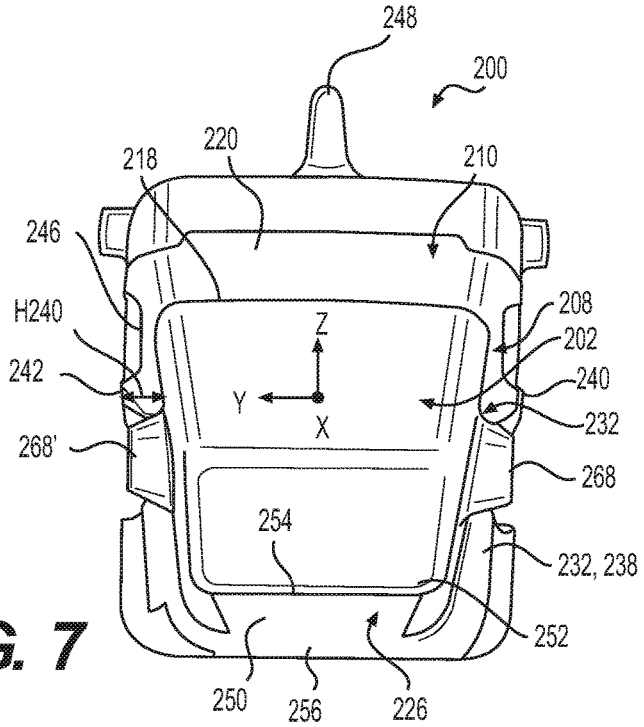
FIG. 7 is a front view of the heavy duty adapter of FIG. 5.

In some embodiments, the throat portion 208 may further include a ridge 240 extending from the side throat surface 232 along the Y-axis, defining a ridge height H240 along a direction parallel with the Y-axis (see FIG. 7). This ridge 240 may also extend along the X-axis to the first leg 204. More particularly, the ridge 240 may define a side ridge surface 242 generally parallel to the X-Z plane and the first leg 204 may define a first leg side surface 244 coplanar with the side ridge surface 242. This may not be the case in other embodiments. The throat portion 208 and the first leg 204 define a pocket 246 and the ridge 240 partially forms that pocket 246. The pocket 246 is designed to receive the tongue 128 of a cap or cover 130 intended to protect the various portions of the tip adapter 200 including its lifting eye 248 (see FIG. 4).

As best seen in FIGS. 6, 8 and 10, the nose portion 202 may include a lower nose surface 250 extending rearwardly from the bottom forward extremity 252 of the nose portion 202. The lower nose surface 250 may include a first planar portion 254 disposed near the bottom forward extremity 252 and a second planar portion 256 extending from the first planar portion 254, defining a lower obtuse angle $\alpha$ with the first planar portion 254. In some embodiments, the lower obtuse angle $\alpha$ ranges from 160 degrees to 180 degrees and may be approximately 170 degrees in some embodiments. Similarly, the first planar portion 254 of the lower nose surface 250 may define a first planar portion length L254 ranging from 5 mm to 20 mm and the first planar portion 254 may generally parallel to the X-axis in some embodiments. Any of these dimensions may be varied as needed or desired.

Also, the throat portion 208 may include a bottom throat surface 226 that is generally coplanar with the second planar portion 256 of the lower nose surface 250. The bottom throat surface 226 may extend to the second leg 206 with a blend 258 connecting the leg bottom surface 260 to the bottom throat surface 226.

As mentioned previously, the throat portion 208 may further include a top throat surface 210, and the slot 212 may define a forward extremity 228 at the closed end 214. The tip adapter 200 may further define a distance 230 from the top throat surface 210 to the bottom throat surface 226 measured along the Z-axis at the forward extremity 228 of the slot 212 ranging from 220 mm to 250 mm in certain embodiments.

As also alluded to earlier herein, the throat portion 208 may define a side throat surface 232 extending substantially from the top throat surface 210 to the bottom throat surface 226, the side throat surface 232 defining a variable blend portion 238 defining a radius of curvature R238 decreasing from proximate the bottom throat surface 226 toward the top throat surface 210, wherein the radius of curvature R238 of the variable blend portion 238 may range as previously described herein.

The slot 212 is bounded by flat bearing surfaces 262 formed by the first leg 204 and the second leg 206, both of which are parallel to the X-axis. The slot 212 is also bounded by an angled bearing surface 264. The forward extremity 228 of the slot 212 is formed by an enlarged radius 266 that provides clearance for the front of the lip of the bucket. These bearing surfaces and the slot may be differently configured as needed or desired. For example, the working edge may be differently configured and the slot and associated bearing surfaces would be changed to match.

Bosses 268 are provided on either side of the tip adapter 200 that are used to retain the tip to the tip adapter using the retaining mechanism in a manner known in the art. The nose portion 202 of the tip adapter 200 may also be differently configured as compared to what is shown depending on the application, etc.

FIG. 10 shows additional contour lines compared to FIGS. 5 thru 9. These additional contour lines indicate that the tip adapter 200 includes draft angles and blends not specifically discussed herein, allowing the tip adapter to be cast. For example, a parting line 270 runs down the middle of the tip adapter since the tip adapter 200 is symmetrical about the X-Z plane. Thus, the flat and arcuate surfaces discussed concerning the tip adapter may be actually bifurcated or further divided. It is to be understood that these features such as draft and blends at corners and intersections are taken into account when using the terms "substantially", "generally" and the like for any of the embodiments of tip adapter, shroud or tip discussed herein. Likewise, distances may be described as being "maximum" or "minimum" as used herein in order to take into consideration these features. Other embodiments may lack such draft features or may have more planes of symmetry or none at all, etc.

Next, an embodiment of tip configured to be attached the tip adapter will be discussed with reference to FIGS. 11 and 12. The tip has a cavity that is at least complimentarily configured to match the nose geometry of the tip adapter. Hence, most of the description of the tip adapter applies equally to the tip and vice versa by understanding that the geometry is substantially mirrored (forming a negative image) from one component to the other. Furthermore, transition geometry will be discussed disposed in the cavity that may match or provide clearance with respect to the corresponding geometry (e.g. the throat geometry) of the tip adapter.

Figure 11:
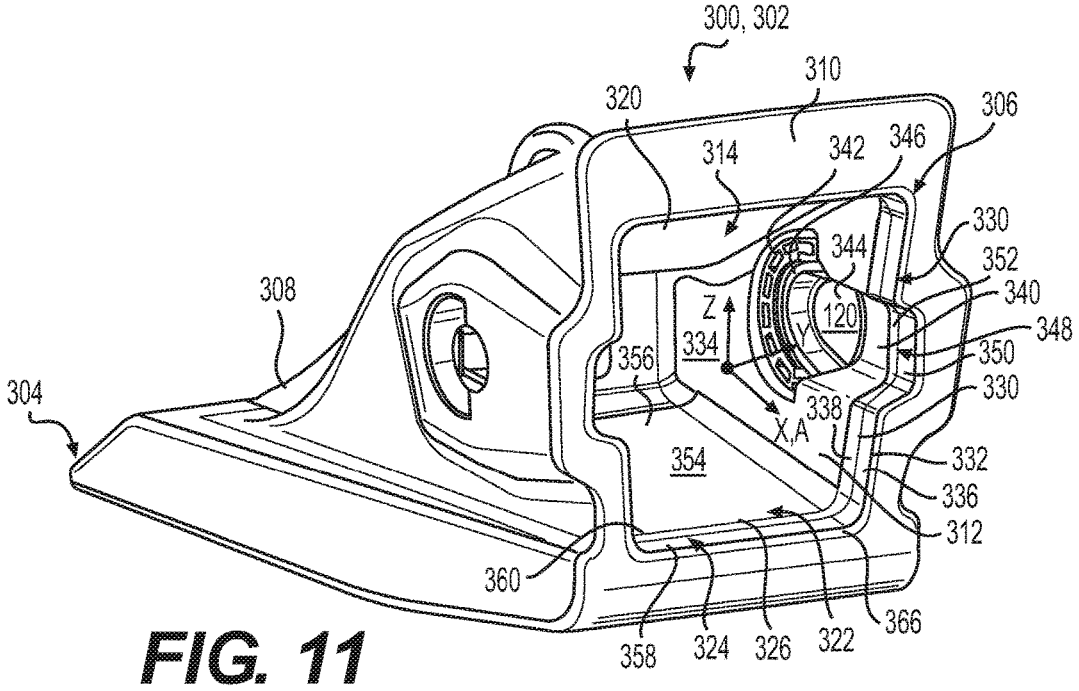
FIG. 11 is a rear oriented perspective view of a heavy duty tip with a plurality of tapered walls according to an embodiment of the present disclosure.
Figure 12:
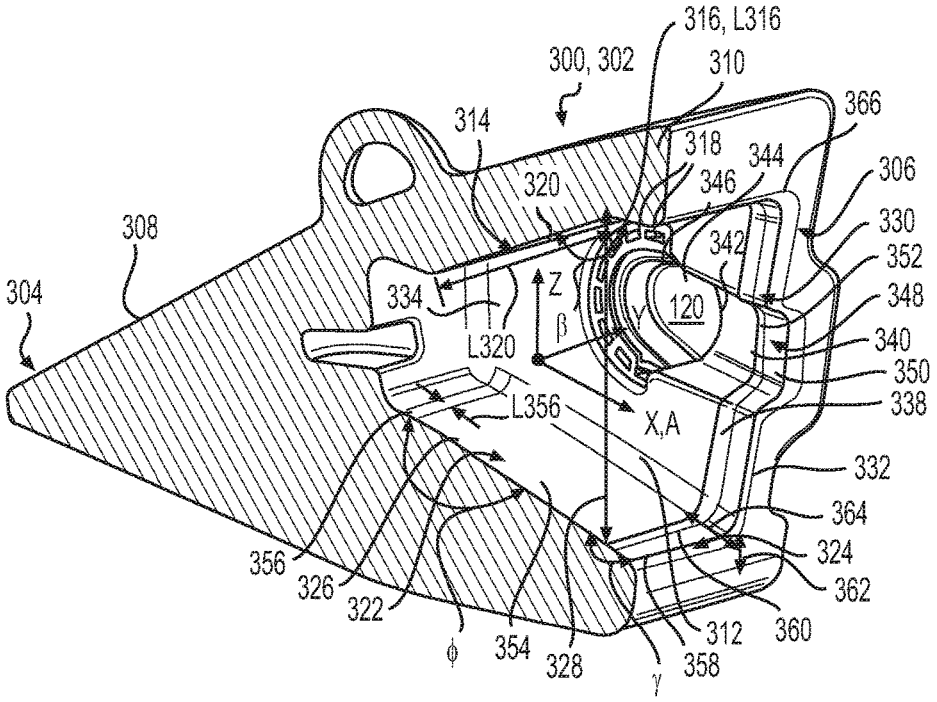
FIG. 12 illustrates the heavy duty tip of FIG. 11 sectioned along its midplane, which is also a plane of symmetry.
Figure 13:
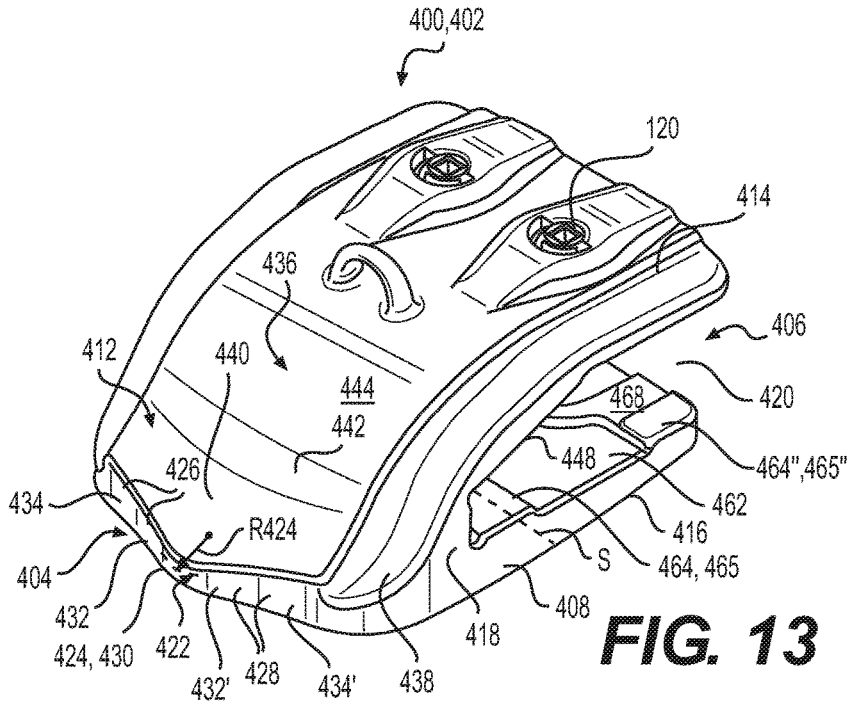
FIG. 13 is a front oriented perspective view of a heavy duty center shroud according to an embodiment of the present disclosure.
Figure 14:
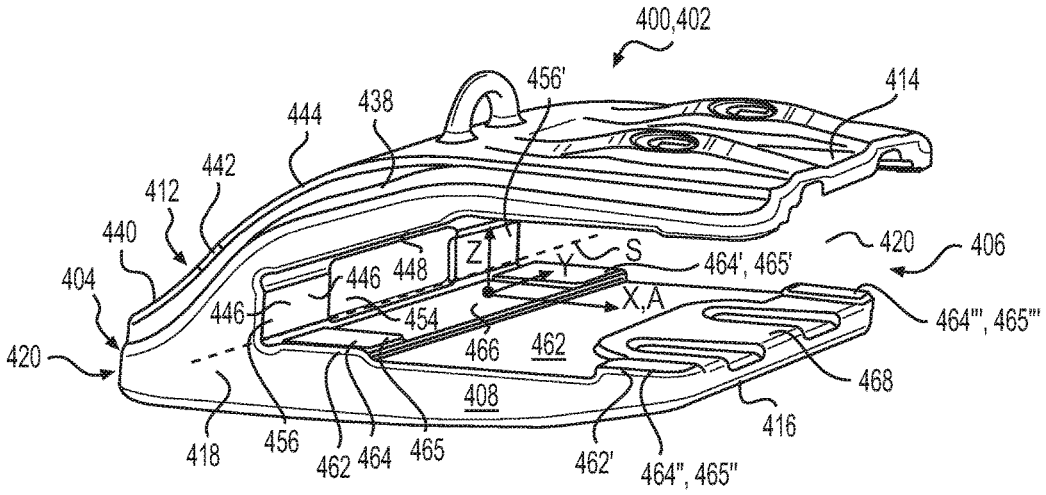
FIG. 14 is a rear oriented perspective view of the heavy duty center shroud of FIG. 13.

Looking at FIGS. 11 and 12, a tip 300 according to an embodiment of the present disclosure may define a cavity for being attached to a work implement and a working portion on the front end. In many applications, a tip adapter as just described may act as the intermediary between the work implement (e.g. a bucket) and the tip. It is to be understood that the working portion and cavity may be differently configured as compared to what is shown and described herein.

The tip 300 may comprise a body 302 including a closed end 304 and an open end 306, a forward working portion 308 disposed proximate the closed end 304, and a rearward connecting portion 310 disposed proximate the open end 306. The rearward connecting portion 310 defines the cavity 312, which extends from the open end 306 toward the closed end 304. The cavity 312 is defined by a plurality of surfaces defining a direction of assembly A and the tip 300 defines a Cartesian coordinate system wherein the X-axis is parallel with the direction of assembly A. The tip 300 may define a cavity upper surface 314 disposed proximate the open end 306, the cavity upper surface 314 including an cavity upper flat portion 316 that is generally parallel to the direction of assembly A and a cavity upper transition portion 318 that extends rearward from the cavity upper flat portion 316 toward the open end 306. The cavity upper transition portion 318 may be configured to avoid interference with a tip adapter or may be configured to match the corresponding geometry of the tip adapter.

The cavity upper flat portion 316 may define a cavity upper flat portion length L316 measured along the X-axis ranging from 5 mm to 20 mm. The cavity 312 may be further defined by a cavity upper angled planar portion 320 extending from the cavity upper flat portion 316 forming an upper obtuse angle β with the cavity upper flat portion 316 projected onto a X-Z plane along the Y axis. The upper obtuse angle β may range from 140 degrees to 160 in some embodiments and may be approximately 150 degrees in certain embodiments. In addition, the cavity upper angled planar portion 320 may define a cavity upper angled planar portion length L320 measured in the X-Z plane, ranging from 120 mm to 160 mm in certain embodiments. The ratio of the cavity upper angled planar portion length L320 to the cavity upper flat portion length L316 may range from 0.04 to 0.125 in some embodiments. Any of these dimensions may be varied as needed or desired.

Opposite of the cavity upper surface 314, the tip 300 may further include a cavity lower surface 322 disposed proximate the open end 306. The cavity lower surface 322 may comprise a cavity lower transition portion 324 extending from the open end 306 toward the closed end 304 and an aft cavity lower angled planar portion 326 extending forwardly from the cavity lower transition portion 324. As a result, the tip 300 may also define a maximum distance 328 from the cavity upper flat portion 316 to the cavity lower surface 322, measured along the Z-axis ranging from 160 mm to 200 mm in some embodiments. The tip 300 may further include a cavity side surface 330 extending substantially from the cavity upper surface 314 to the cavity lower surface 322. The cavity side surface 330 may define a cavity side transition portion 332 configured to avoid interference with a tip adapter or to closely match the corresponding geometry of the tip adapter. The cavity side transition portion 332 may also extend substantially from the cavity upper surface 314 to the cavity lower surface 322 in some embodiments.

The cavity 312 or cavity side surface 330 is further defined by a side bearing surface 334 and the cavity side transition portion 332 includes a planar portion 336 disposed proximate the open end 306 and a radial portion 338 blending the planar portion 336 to the side bearing surface 334. The cavity side surface 330 jogs along the Y-axis, forming a boss receiving slot 340. The attachment mechanism 120 is disposed in an aperture 342 positioned at the blind end of the slot 340. The boss receiving slot 340 is defined by lead-in features 348 that help the boss of the tip adapter find its way into the catch pocket 344 defined by the attachment mechanism 120 as the tip 300 is inserted onto the nose portion of the tip adapter. Once the boss is inserted into the catch pocket 344, the attachment mechanism 120 may be rotated 180 degrees until the boss is trapped by the catch lip 346 of the attachment mechanism 120 in a manner known in the art. The lead-in features 348 may be configured in any suitable manner including those discussed already herein with respect to transitional geometry in general. For the embodiment shown in FIGS. 11 and 12, the lead-in features 348 include a chamfered portion 350 disposed proximate the open end 306 and a radial portion 352 (i.e. a radial blend) extending forwardly from the chamfered portion 350.

Focusing now on the cavity lower surface 322, it can be seen that the cavity lower surface 322 may include a cavity first lower planar surface 354 spaced away from the open end 306 and a cavity second lower planar surface 356 extending forwardly of the cavity first lower planer surface 354, forming an oblique angle φ therewith. The oblique angle φ may range from 160 degrees to 180 degrees and may be approximately 170 degrees in some embodiments. The cavity lower surface 322 may include a cavity lower transition portion 324 disposed proximate the open end 306 and connected to the cavity first lower planar surface 354. The cavity lower transition portion 324 may also be configured to clear or match closely the corresponding geometry of the tip adapter and may be constructed in any suitable manner.

For the embodiment shown in FIGS. 11 and 12, the cavity lower transition portion 324 includes a planar portion 358 disposed proximate the open end 306 and a radial portion 360 blending the planar portion 358 to the cavity first lower planar surface 354. The planar portion 358 of the cavity lower transition portion 324 may form an angle γ with the cavity first lower planar surface 354 ranging from 160 degrees to 180 degrees and may be approximately 170 degrees in some embodiments. Also, the tip 300 is symmetrical about the X-Z plane but other embodiments of the tip may have more or no planes of symmetry.

Furthermore, the cavity second lower planar portion 356 may define a cavity second lower planar portion length L356 measured in the X-Z plane ranging from 5 mm to 20 mm in some embodiments. Also, the cavity second lower planar portion 356 may be generally parallel with the X-axis. This version of the tip is shown to be symmetrical about the X-Z plane of the tip (X-axis passes through the center of mass of the tip). Any of these dimensions or angles discussed herein may be varied as needed or desired.

For the embodiment of the tip 300 disclosed in FIGS. 11 and 12, all of the transition portions 318, 324, 332, and 348 are similarly configured. As best seen in FIG. 12 by looking at the cavity lower transition portion 324, the geometry for this features moves downwardly a distance 362 in the Z direction (or along the Z-axis) and extends rearward a distance 364 in the X direction (or along the X-axis). One may the outline of the lower transition portion 324 and sweep it along the perimeter 366 of the cavity 312 to essentially create or understand the configuration of the geometry of all the transition portions. This may not be the case in other embodiments.

Figure 18:
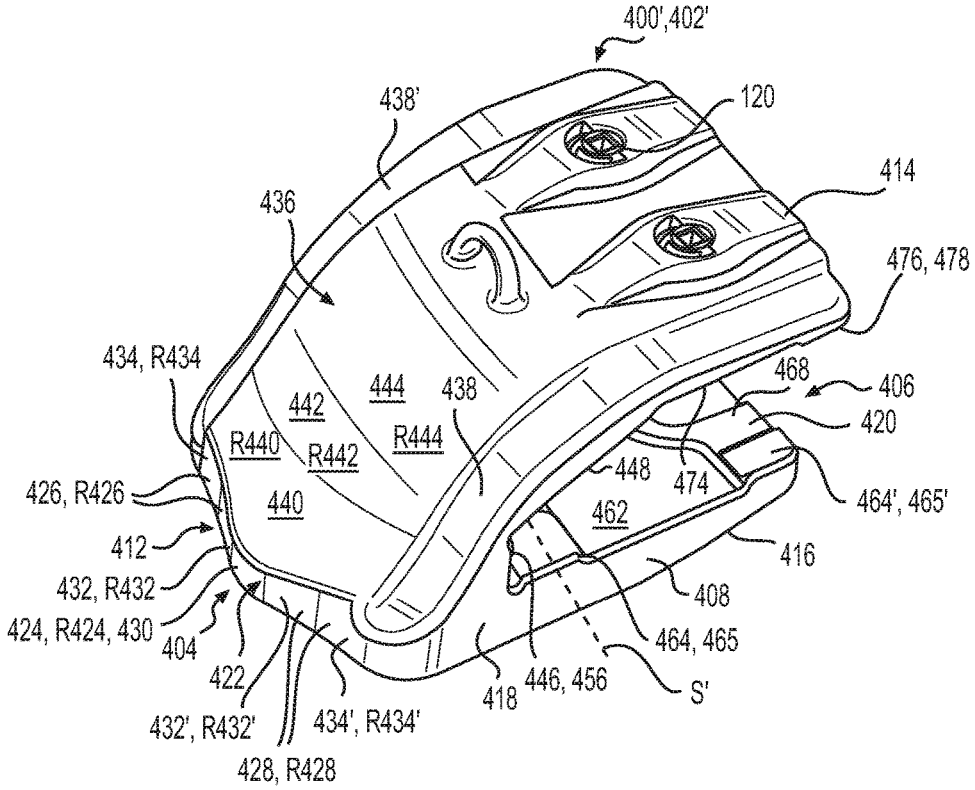
FIG. 18 is a front oriented perspective view of a heavy duty right handed shroud according to an embodiment of the present disclosure.
Figure 19:
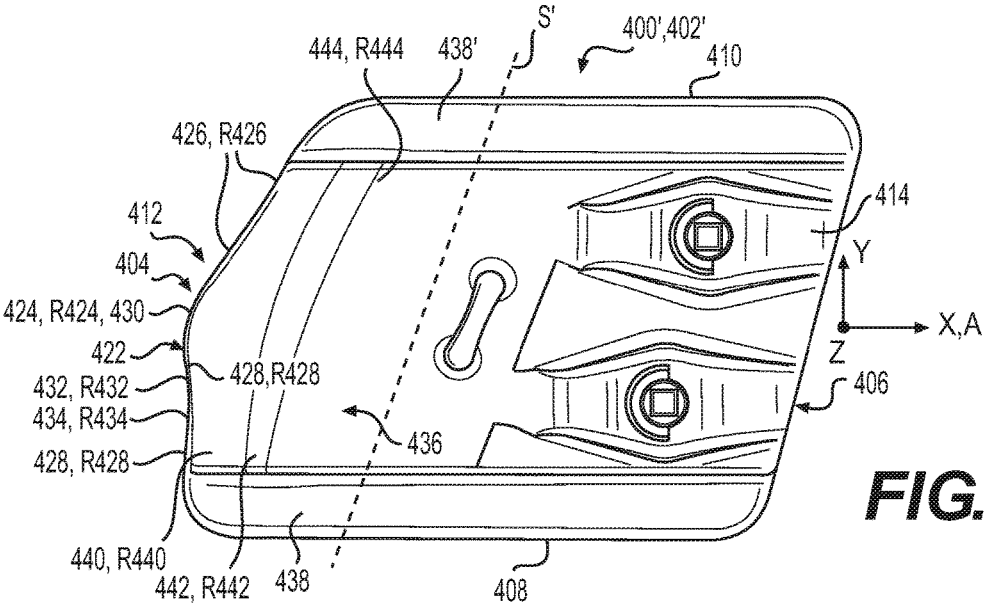
FIG. 19 is a top view of the heavy duty right handed shroud of FIG. 18.
Figure 20:
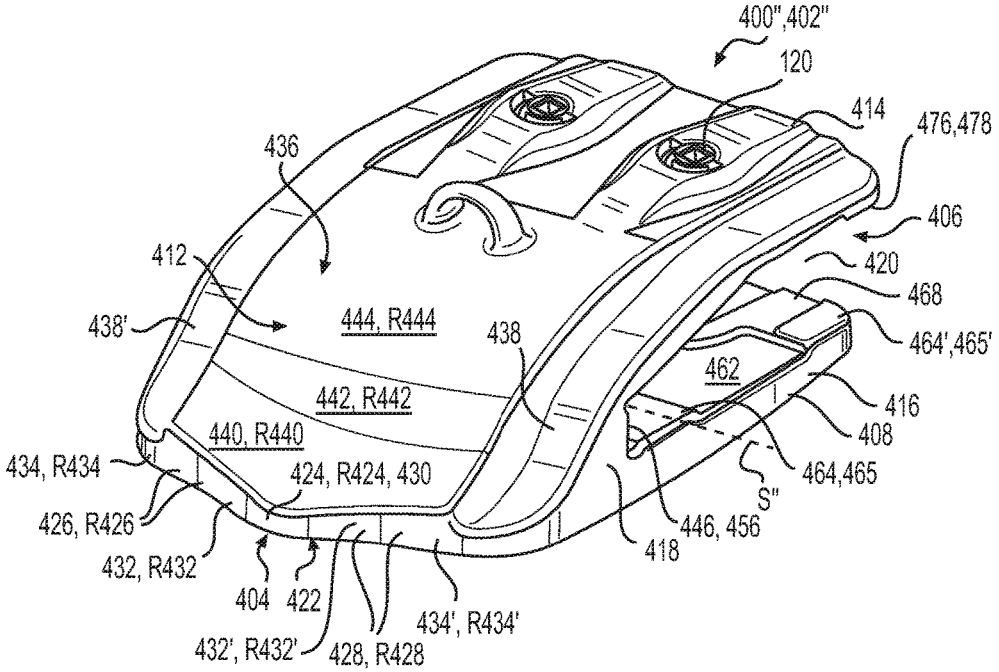
FIG. 20 is a front oriented perspective view of a heavy duty left handed shroud according to an embodiment of the present disclosure.
Figure 21:
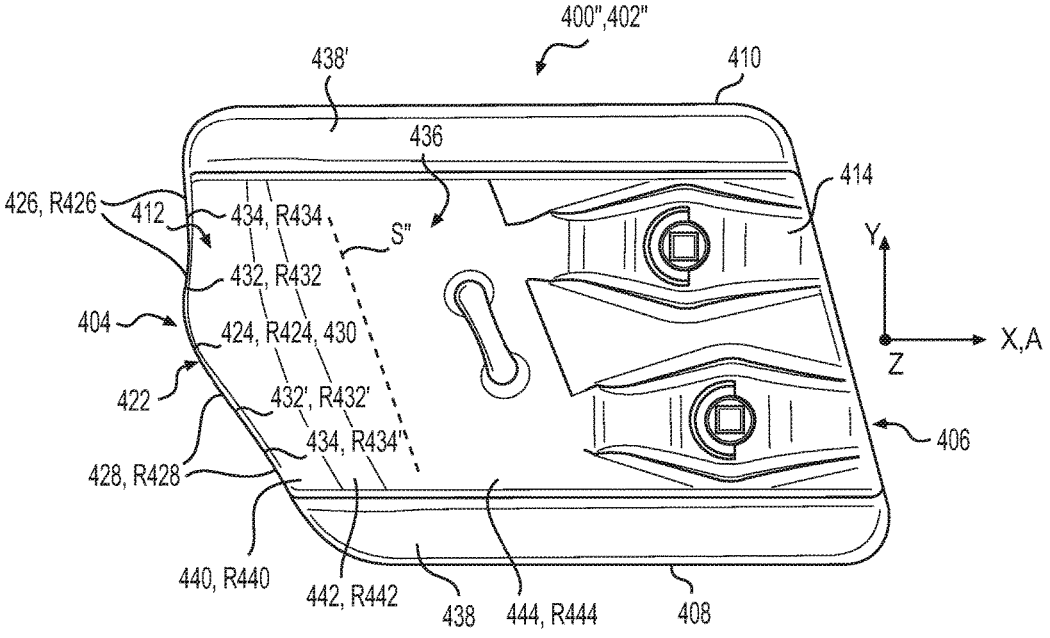
FIG. 21 is a top view of the heavy duty left handed shroud of FIG. 20.
Figure 22:
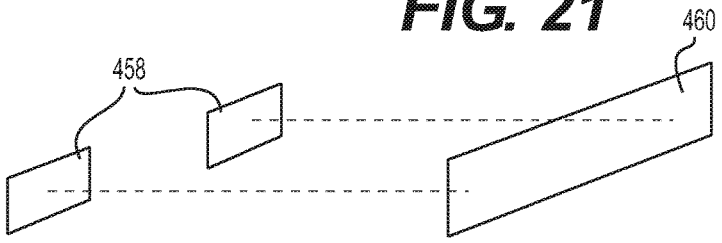
FIG. 22 shows the projected areas of the rearward facing pads of a heavy duty shroud compared to the projected area of the projected area of the entire front surface of the slot of the heavy duty shroud according to an embodiment of the present disclosure.
Figure 23:
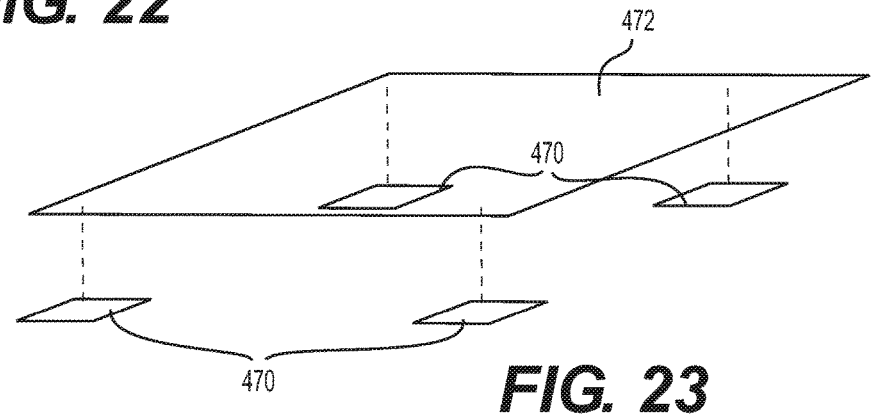
FIG. 23 shows the projected areas of the upward facing pads of a heavy duty shroud compared to the projected area of the projected area of the entire lower leg of the heavy duty shroud according to an embodiment of the present disclosure.

Now various embodiments of a shroud of the present disclosure will be described with respect to FIGS. 13 thru 23. More particularly, FIGS. 13 thru 17 are directed to a center shroud, FIGS. 18 and 19 are directed to a right handed shroud while FIGS. 20 and 21 are directed to a left handed shroud.

Starting with FIGS. 13 thru 17, the shroud 400 is configured to be attached to a work implement. The shroud 400 may comprise a body 402 defining a closed end 404, an open end 406, a first side surface 408 and a second side surface 410. The first side surface 408 and the second side surface 410 span from the closed end 404 to the open end 406. A working portion 412 is disposed proximate the closed end 404, a first leg 414 extends rearward from the working portion 412 to the open end 406, and a second leg 416 extends rearward from the working portion 412 to the open end 406. The side surfaces 408, 410 also form the side surfaces of the legs 414, 416. A throat portion 418 connects the legs 414, 416 and working portion together 412. The first and second legs 414, 416 define a slot 420, the slot 420 defining a direction of assembly A onto a work implement and the body 402 defines a Cartesian coordinate system wherein the X-axis is parallel with the direction of assembly A. The working portion 412 defines a ground engaging surface 422 at the closed end 404 that may comprise a convex arcuate portion 424 intersecting with the X-axis, a first concave arcuate portion 426 extending from the convex arcuate portion 424 toward the first side surface 408, and a second concave arcuate portion 428 extending from the convex arcuate portion 424 toward the second side surface 410 when the ground engaging surface 422 is projected onto a X-Y plane along the Z-axis.

In some embodiments, the convex arcuate portion 424 may define a radius of curvature R424 projected onto a X-Y plane along the Z-axis ranging from 80 mm to 120 mm. Similarly, in some embodiments, the first concave arcuate portion 426 may define a radius of curvature R426 projected onto a X-Y plane along the Z-axis ranging from 350 mm to 450 mm. Also, the second concave arcuate portion 428 may define a radius of curvature R428 projected onto a X-Y plane along the Z-axis ranging from 350 mm to 450 mm. The ground engaging surface thus constructed may be well suited for penetrating the ground or other working surface. Flute portions 438 may be provided on top of the shroud proximate the first and second side surfaces for conveying material as the shroud penetrates a work surface. Other configurations for the ground engaging surfaces are possible.

Figure 17:
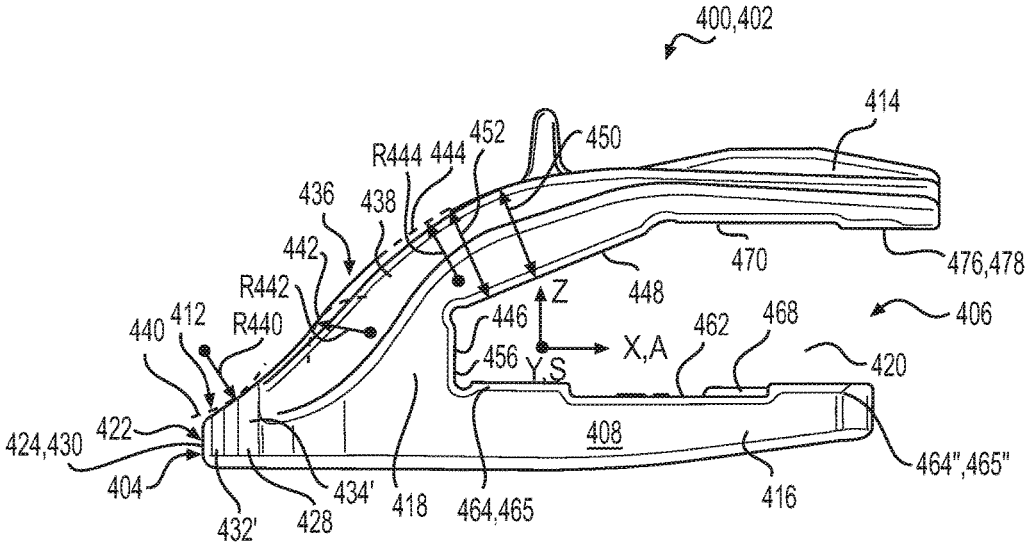
FIG. 17 is a side view of the heavy duty center shroud of FIG. 13.

For the embodiment of the shroud 400 shown in FIGS. 13 thru 17, the X-Z plane defines a plane of symmetry for the body 402 of the shroud, yielding a center shroud. As a result, the first concave portion 426 extends primarily in the positive Y direction (or along the Y-axis) and slightly in the positive X direction (or along the X-axis) while the second concave portion 428 extends primarily in the negative Y direction and slightly in the positive X direction (or along the positive X-axis) to a similar extent in both the X and Y directions (or along the X-axis and Y-axis). As best seen in FIG. 17, the convex arcuate portion 424 comprises a single face 430 (may be or approximate an exact radius). On the other hand, both the first concave arcuate portion 426 and the second concave arcuate portion 428 each comprise two different faces (i.e. first face 432 and second face 434) that may have slightly different radii of curvature R432, R434.

For FIGS. 18 and 19, the shape of the ground engaging surface 422' is modified compared to the ground engaging surface 422 of the center shroud, but may be described and measured in a similar manner. For example, the first concave arcuate portion 426' extends in the X and Y directions (or along the X-axis and the Y-axis) to a similar extent, while the second concave arcuate portion 428' extends primarily in the negative Y direction (or along the negative Y-axis) and slightly in the X direction (or along the X-axis). Hence, the ground engaging surface 422' follows the sweep path S defined by the front of the slot 420' of the right handed shroud 400', which mates with and mimics the front edge of the bucket. As best seen in FIG. 18, the convex arcuate portion 424' comprises a single face 430' (may be or approximate an exact radius). On the other hand, both the first concave arcuate portion 426' and the second concave arcuate portion 428' comprise two different faces 432', 434' that may have slightly different radii of curvature R432', R434'.

FIGS. 20 and 21 show that the left handed shroud 400" is a mirror image of the right handed shroud. Accordingly, the first concave arcuate portion 426" extends primarily in the Y direction (or along the Y-axis) and slightly in the X direction (or along the X-axis), while the second concave arcuate portion 428" extends in the X and negative Y directions (or along the X-axis and the negative Y-axis) to a similar extent. As best seen in FIG. 20, the convex arcuate portion 424" comprises a single face 430" (may be or approximate an exact radius). On the hand, both the first concave arcuate portion 426" and the second concave arcuate portion 428" comprise two different faces 432", 434" that may have slightly different radii of curvature R432", R434".

Returning to FIGS. 13 thru 17, in addition to the working portion 412 defining a ground engaging surface 422 at the closed end 404, the working portion 412 may also include an upper outside loading surface 436 extending from the ground engaging surface 422 toward the open end 406 and the first leg 414. The upper outside loading surface 436 may comprise a first concave arcuate loading portion 440 extending from the ground engaging surface 422 toward the first leg 414, a first convex arcuate loading portion 442 extending from the first concave arcuate loading portion 440 toward the first leg 414, and a second convex arcuate loading portion 444 extending from the first convex arcuate loading portion 442 toward the first leg 414. Since a center shroud is shown, the slot 420 *s* defined by a front abutment face 446 defining a sweep path S and the first concave arcuate loading portion 440 defines a radius of curvature R440 projected onto the X-Z plane along the sweep path S (parallel to the Y-axis in this instance) ranging from 250 mm to 350 mm (see FIG. 17). Similarly, the first convex arcuate loading portion 442 defines a radius of curvature R442 projected onto the X-Z plane along the sweep path S ranging from 100 mm to 150 mm. Likewise, the second convex arcuate loading portion 444 defines a radius of curvature R444 projected onto the X-Z plane along the sweep path S ranging from 100 mm to 200 mm.

As alluded to earlier, the right handed shroud 400' of FIGS. 18 and 19 and the left handed shroud 40" of FIGS. 20 and 21 have sweep paths S', S" that are angled relative to the Y-axis to match the front edge of a bucket. However, their geometry regarding the upper outside loading surface 436', 436" may be similarly described and measured. The geometry concerning the upper outside loading surface may be modified for any shroud of any embodiment of the present disclosure but may provide more strength in use than previous shrouds known in the art in some cases.

Looking at FIG. 17, each shroud 400 has a body 402 defining a slot 420 that includes an upper slot angled bearing surface 448 and that defines a maximum distance 450 from the upper slot angled bearing surface 448 to the second convex arcuate loading portion 444 measured in a direction perpendicular to the upper slot angled bearing surface 448 ranging from 40 mm to 120 mm. A minimum distance 452 is similarly provided and measured.

For many embodiments of the shroud, it is desirable to help ensure that the slot of the shroud is snugly engaged with the front edge of the bucket. Consequently, referring to FIGS. 13 thru 21, each shroud 400 may define a slot 420 defining a front clearance face 454 and the body 402 may further include a first rearward facing pad 456 extending from the front clearance face 454 along the X-axis adjacent the first side surface 408 and a second rearward facing pad 456' extending from the front clearance face 454 along the X-axis adjacent the second side surface 410 (see FIG. 14). The rearward facing pads 456, 456' are configured to contact the front face of the front lip of the bucket. The rear facing pads extend approximately 4 mm (+/−1 mm) from the front clearance face 454. As best understood with reference to FIG. 22, the rearward facing pads 456 define a total rearward facing pad surface area 458 (e.g. 8500 $mm^2$ after adding the surface area of each pad together) and the front clearance face with the rear facing pads defines a total front clearance face surface area 460 (e.g. 11200 $mm^2$), and the total rearward facing pad surface area 458 divided by the total front clearance face surface area 460 ranges from 0.6 to 0.90 and may be approximately 0.75 in some embodiments. These surface areas may be measured by projecting them onto a Y-Z plane along the X direction (or along the X-axis).

In like fashion, the body 402 may further comprise a bottom clearance face 462 in the slot 420 defining a generally rectangular configuration with four corners 464 and four upward facing pads 465 positioned at the four corners of the bottom clearance face 462 extending in the Z direction (or along the Z-axis). A front intermediate platform 466 may extend along the Z direction (or along the Z-axis) from the bottom clearance face 462 (extends about half the distance of the upward facing pads) and along the sweep path S, connecting two forward instances of the upward facing pads 465 together. Also, a rear intermediate platform 468 (extends about half the distance of the upward facing pads) may extend along the Z direction (or along the Z-axis) from the bottom clearance face 462, connecting the two rearward instances of the upward facing pads 465 together. The upward facing pads 465 may extend approximately 10 mm (+/−1 mm) from the bottom clearance face 462, the upward facing pads 465 define a total upward facing pad surface area 470 (e.g. 10000 $mm^2$) and the bottom clearance face defines a total bottom clearance face surface area 472 (e.g. 17000 $mm^2$), and the total upward facing pad surface area 470 divided by the total bottom clearance face surface area 472 ranges from 0.4 to 0.6 (see FIG. 23) and may be approximately 0.588 in some embodiments.

Figure 15:
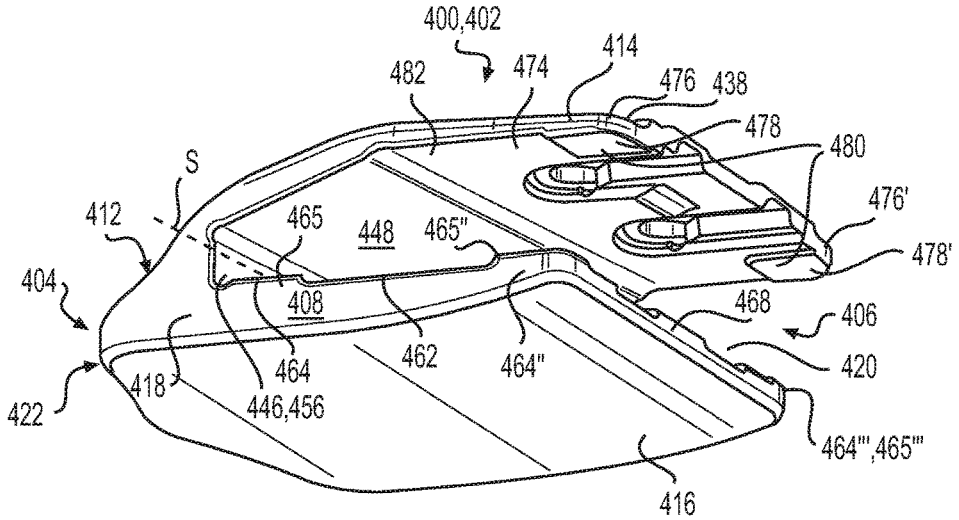
FIG. 15 is an alternate rear oriented perspective view of the heavy duty center shroud of FIG. 13, showing the upper pads in the slot of the shroud more clearly.
Figure 16:
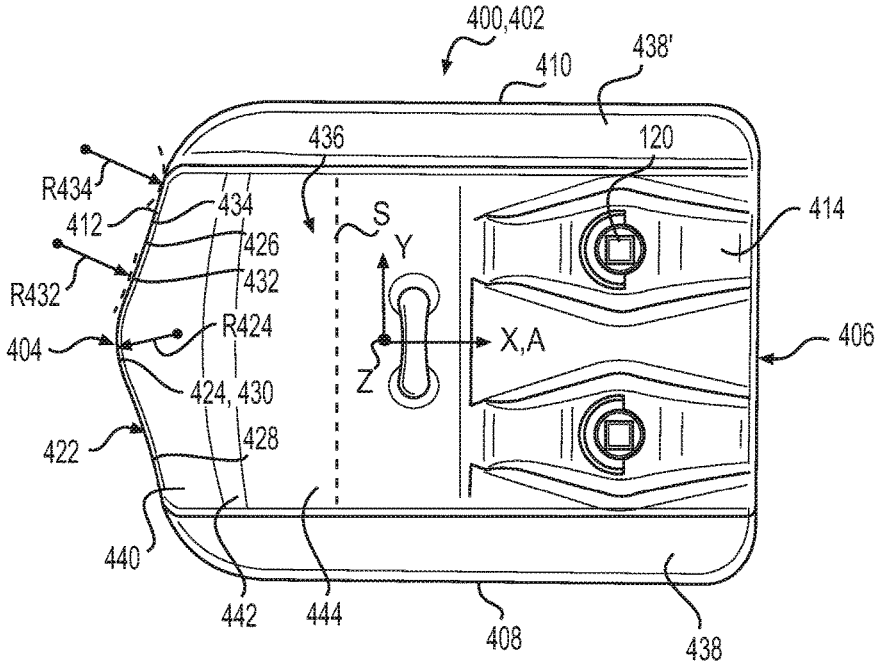
FIG. 16 is a top view of the heavy duty center shroud of FIG. 13.

As best seen in FIG. 15, the body of the shroud may further comprise a top clearance face 474 in the slot 420 defining a generally rectangular configuration with two rear corners 476 and two downward facing pads 478 positioned at the two rear corners 476 extending in the negative Z direction (or along the negative Z-axis). The downward facing pads 478 may extend approximately 4 mm from the top clearance face 474. The downward facing pads 478 may also define a total downward facing pad surface area 480 (e.g. 8500 $mm^2$) and the top clearance face defines a total top clearance face surface area 482 (e.g. 39000 $mm^2$), and the total downward facing pad surface area 480 divided by the total top clearance face surface area 482 ranges from 0.2 to 0.3 and may be approximately 0.218 in some embodiments.

The configuration of any embodiment of an adapter, tip, or shroud of the present disclosure, as well as associated features, dimensions, angles, surface areas, and ratios may be adjusted as needed or desired.

INDUSTRIAL APPLICABILITY

In practice, a work implement such as a bucket may be sold with one or more shrouds, adapters or tips according to any of the embodiments discussed herein. In other situations, a kit that includes components for retrofitting an existing work implement or a newly bought work implement with one or more shrouds, adapter or tips may be provided. It is further contemplated that a shroud, adapter, or tip may be provided separately or in any combination with other shrouds, adapters, or tips.

Economic endeavors such as mining operations may require that a work implement be used under harsh conditions and the severity of the operation conditions may be ascertained when shrouds, adapters and/or tips are frequently needed to be repaired or replaced. If so, then the user or the entity conducting the operation may opt to purchase or otherwise obtain work implements using shrouds, adapters, and/or tips as described herein. Alternatively, the individual shrouds, adapters, and/or tips may be individually procured.

Other entities may provide, manufacture, sell, retrofit or otherwise obtain work implements having the shrouds, adapters, and/or tips according to any embodiment discussed herein or may provide, manufacture, sell, refurbish, remanufacture, or otherwise obtain shrouds, adapters, and/or tips individually or in any suitable combination, etc.

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. Also, the numbers recited are also part of the range.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps or combined. Furthermore, variations or modifications to certain aspects or features of various embodiments may be made to create further embodiments and features and aspects of various embodiments may be added to or substituted for other features or aspects of other embodiments in order to provide still further embodiments.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A shroud configured to be attached to a work implement, the shroud comprising:

a body defining a closed end and an open end, a first side surface and a second side surface;

a working portion disposed proximate the closed end;

a first leg extending rearward from the working portion to the open end;

a second leg extending rearward from the working portion to the open end; and a throat portion that connects the legs and working portion together;

wherein the first and second legs define a slot, the slot defining a direction of assembly onto a work implement and the body defines a Cartesian coordinate system having a X-axis, a Y-axis and a Z-axis and defining a X-Y plane, a X-Z plane, and a Y-Z plane, wherein the X-axis is parallel with the direction of assembly; and the working portion defines a ground engaging surface at the closed end comprising a convex arcuate portion intersecting with the X-axis, a first concave arcuate portion extending from the convex arcuate portion toward the first side surface, and a second concave arcuate portion extending from the convex arcuate portion toward the second side surface when the ground engaging surface is projected onto a X-Y plane along the Z-axis.

2. The shroud of claim 1, wherein the convex arcuate portion defines a radius of curvature projected onto a X-Y plane along the Z-axis ranging from 80 mm to 120 mm.

3. The shroud of claim 1, wherein the first concave arcuate portion defines a radius of curvature projected onto a X-Y plane along the Z-axis ranging from 350 mm to 450 mm.

4. The shroud of claim 1, wherein the second concave arcuate portion defines a radius of curvature projected onto a X-Y plane along the Z-axis ranging from 350 mm to 450 mm.

5. The shroud of claim 1, wherein the X-Z plane defines a plane of symmetry for the body of the shroud, yielding a center shroud.

6. The shroud of claim 1, wherein the first concave arcuate portion extends along the X and Y axes, while the second concave arcuate portion extends primarily along the negative Y-axis and slightly along the X-axis.

7. The shroud of claim 1, wherein the first concave arcuate portion extends primarily along the Y-axis and slightly along the X-axis, while the second concave arcuate portion extends along the X-axis and the negative Y-axis.

8. A shroud configured to be attached to a work implement, the shroud comprising:

a body defining a closed end and an open end, a first side surface and a second side surface;

a working portion disposed proximate the closed end;

a first leg extending rearward from the working portion to the open end;

a second leg extending rearward from the working portion to the open end; and a throat portion that connects the legs and working portion together;

wherein the first and second legs define a slot, the slot defining a direction of assembly onto a work implement and the body defines a Cartesian coordinate system at its center of mass having a X-axis, a Y-axis and a Z-axis and defining a X-Y plane, a X-Z plane, and a Y-Z plane, wherein the X-axis is parallel with the direction of assembly; and the working portion defines a ground engaging surface at the closed end and an upper outside loading surface extending from the ground engaging surface toward the open end and the first leg, the upper outside loading surface comprising a first concave arcuate loading portion extending from the ground engaging surface toward the first leg, a first convex arcuate loading portion extending from the first concave arcuate loading portion toward the first leg, and a second convex arcuate loading portion extending from the first convex arcuate loading portion toward the first leg wherein the upper outside loading surface including the first concave arcuate surface extends through the X-Z plane.

9. The shroud of claim 8, wherein the slot is defined by a front abutment face defining a sweep path in the X-Y plane, and the first concave arcuate loading portion defines a radius of curvature projected onto the X-Z plane along the sweep path ranging from 250 mm to 350 mm.

10. The shroud of claim 9, wherein the sweep path is parallel to the Y-axis.

11. The shroud of claim 8, wherein the X-Z plane defines a plane of symmetry of the body, yielding a center shroud.

12. The shroud of claim 8, wherein the slot is defined by a front abutment face defining a sweep path in the X-Y plane, and the first convex arcuate loading portion defines a radius of curvature projected onto the X-Z plane along the sweep path ranging from 100 mm to 150 mm.

13. The shroud of claim 8, wherein the slot is defined by a front abutment face defining a sweep path in the X-Y plane, and the second convex arcuate loading portion defines a radius of curvature projected onto the X-Z plane along the sweep path ranging from 100 mm to 200 mm.

14. The shroud of claim 10, wherein the body includes an upper slot angled bearing surface and defines a maximum distance from the upper slot angled bearing surface to the second convex arcuate loading portion measured in a direction perpendicular to the upper slot angled bearing surface ranging from 40 mm to 120 mm.

* * * * *